US006173930B1

(12) United States Patent
Arbucci

(10) Patent No.: US 6,173,930 B1
(45) Date of Patent: Jan. 16, 2001

(54) WINDOW SUPPORT AND METHOD

(76) Inventor: Ernest Arbucci, 62 First Ave., Massapequa Park, NY (US) 11762

( * ) Notice: Under 35 U.S.C. 154(b), the term of this patent shall be extended for 0 days.

(21) Appl. No.: 09/182,486

(22) Filed: Oct. 30, 1998

(51) Int. Cl.[7] ..... A47F 5/00

(52) U.S. Cl. ..... 248/208; 108/47; 248/231.41; 248/236; 248/241; 248/316.4

(58) Field of Search ..... 248/236, 208, 248/207, 231.41, 316.4, 228.1, 228.3; 108/46; 211/90; 182/53, 54, 55, 56

(56) References Cited

U.S. PATENT DOCUMENTS 1,224,127 * 5/1917 Bartlett .
1,531,159 * 3/1925 Timmons ..... 248/236
1,627,241 * 5/1927 Johnson .
2,061,937 * 11/1936 Fay ..... 211/49.1
2,558,323 * 6/1951 Strun ..... 108/149
2,628,052 * 2/1953 Cira ..... 248/236
2,654,227 * 10/1953 Muffly ..... 62/3
2,717,139 * 9/1955 Jewell ..... 248/208
3,302,553 * 2/1967 Shearn ..... 98/94
3,394,910 * 7/1968 Ulich ..... 248/208
3,433,443 * 3/1969 Mangan et al. ..... 248/214
4,862,812 * 9/1989 Godfrey ..... 108/47
5,112,015 * 5/1992 Williams ..... 248/236
5,553,824 * 9/1996 Dutra, Jr. ..... 248/346.07
5,636,816 * 6/1997 Burton et al. ..... 248/208
5,967,478 * 10/1999 Tynes ..... 248/241

* cited by examiner

*Primary Examiner*—Ramon O. Ramirez
*Assistant Examiner*—Tan Le
(74) *Attorney, Agent, or Firm*—Collard & Roe, P.C.

(57) ABSTRACT

This invention is a telescoping window support which spans the width of the window to provide support for an air conditioner or the like. The support includes first and second halves which each comprise a plurality of fingers which engage one another in a sliding fashion for proper telescoping. Wedges may be selectively attached to level the support on the window sill.

8 Claims, 4 Drawing Sheets

WINDOW SUPPORT AND METHOD

BACKGROUND OF THE INVENTION

1. Field of the Invention

This invention pertains to a window mounted support for air conditioners or the like.

2. Description of the Prior Art and Objectives of the Invention

Window mounted air conditioners have become a staple addition to many older houses, trailers and the like. These window mounted air conditioners unfortunately frequently require support in addition to the window sill. Several attempts in the past have been made to meet this need as demonstrated by U.S. Pat. Nos. 5,112,015; 2,628,052; 1,224,127; 1,627,241; and 2,654,227 among others. While these older devices perform adequately for their purpose, improvements are still sought.

One problem that remains with the prior art devices is that air conditioners and windows come in a myriad of sizes. While U.S. Pat. No. 5,112,015 is "front-to-back" size adjustable, it is not side to side adjustable. Thus, if an air conditioner of inordinate girth is placed thereon, the device will only support a portion of the air conditioner.

Thus, with the above mentioned concern, it is an objective of the present invention to provide a window support which telescopes so as to fit within the majority of conventional windows.

It is a further objective of the present invention to provide a window support which telescopes to accommodate the majority of standard window air conditioning units.

It is still a further objective of the present invention to provide a window support which includes a movable sill foot and wedge to properly level the window support.

It is yet a further objective of the present invention to provide a window support which is economical to make.

It is another objective to provide a window support which requires no external fasteners to install.

It is still another objective to provide a method of installing a window support which is comparatively simple in construction and design.

These and other objectives and advantages will become readily apparent to those skilled in the art upon reference to the following detailed description and accompanying drawing figures.

SUMMARY OF THE INVENTION

The aforedescribed objectives and advantages are realized by providing a window support comprising a first and second half which slidingly, telescopingly engage one another utilizing a plurality of fingers. The support is preferably made of a durable, rigid polymeric material such as polypropelene. Flanges allow proper positioning of a window air conditioner on the top surface. The bottom surface includes a pair of channels which receive sill feet and wedges for proper leveling of the window support on a sill. Each of the wedges is generally trapezoidal with an elliptical knob which fits within one of the channels. Conventional fasteners such as bolts or screws may be used to attach the wedges to the support. The fingers are complementarily s-shaped in cross section so as to engage one another.

The preferred method of use comprises providing a window support substantially as described, placing it upon a window sill, and telescoping the first half and second half to span the width of the window. Sill feet and wedges are then attached as needed to properly level the window support and the air conditioning unit is then placed upon the support. After use is completed such as in cold winter months, the steps are reversed for removal and storage.

DETAILED DESCRIPTION OF THE PREFERRED EMBODIMENTS AND OPERATION OF THE INVENTION

Figure 1:
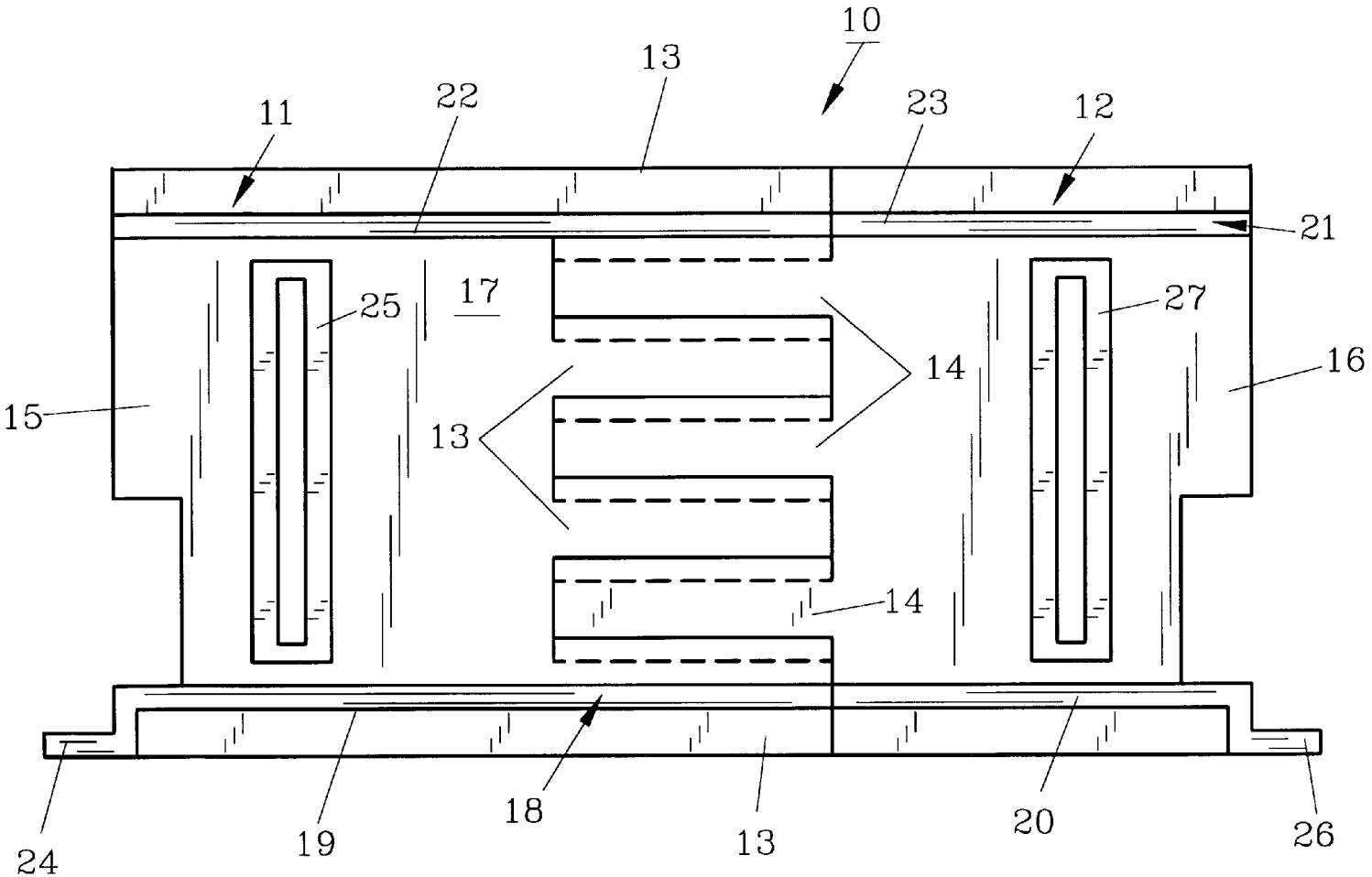
FIG. 1 shows a top view of the window support of the present invention.

Turning now to the drawings, specifically FIG. 1 shows preferred telescoping window support 10, which includes first half 11 and second half 12. First half 11 comprises first plurality of fingers 13, preferably four, extending from generally planar body 15. Second half 12 comprises second plurality of fingers 14, preferably three, extending from generally planar body 16. Fingers 13 and 14 opposingly, slidingly engage one another. Window support 10 is preferably made from a rigid, durable, polymeric material such as polypropelene. First half 11 and second half 12 are both preferably 20.75 inches long (52.71 cm) with fingers 13 and 14 each being 10.25 inches (26.04 cm) in length.

Figure 3:
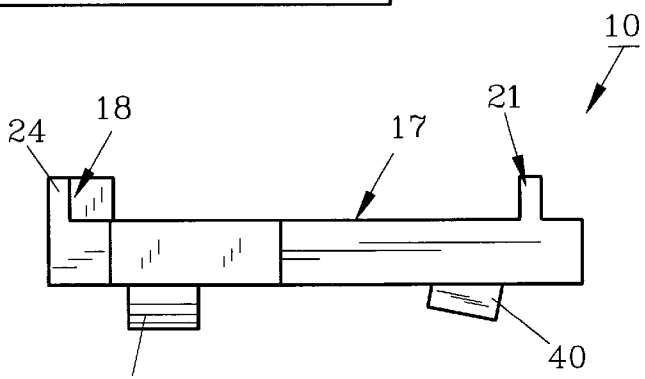
FIG. 3 demonstrates an end view of the window support of FIG. 1.

As seen in FIGS. 1 and 3, on top surface 17 of window support 10, front flange 18 is divided into first portion 19 and second portion 20 located on first half 11 and second half 12 respectively. First portion 19 and second portion 20 are generally s-shaped. Also positioned on top surface 17 of window support 10, is back flange 21 divided into first portion 22 and second portion 23. First portion 22 and second portion 23 are positioned on first half 11 and second half 12 respectively. First half 11 also includes wing 24 and first channel 25, while second half 12 includes wing 26 and second channel 27. Front flange 18 and back flange 21 help position an air conditioner (not shown) correctly therebetween.

Figure 2:
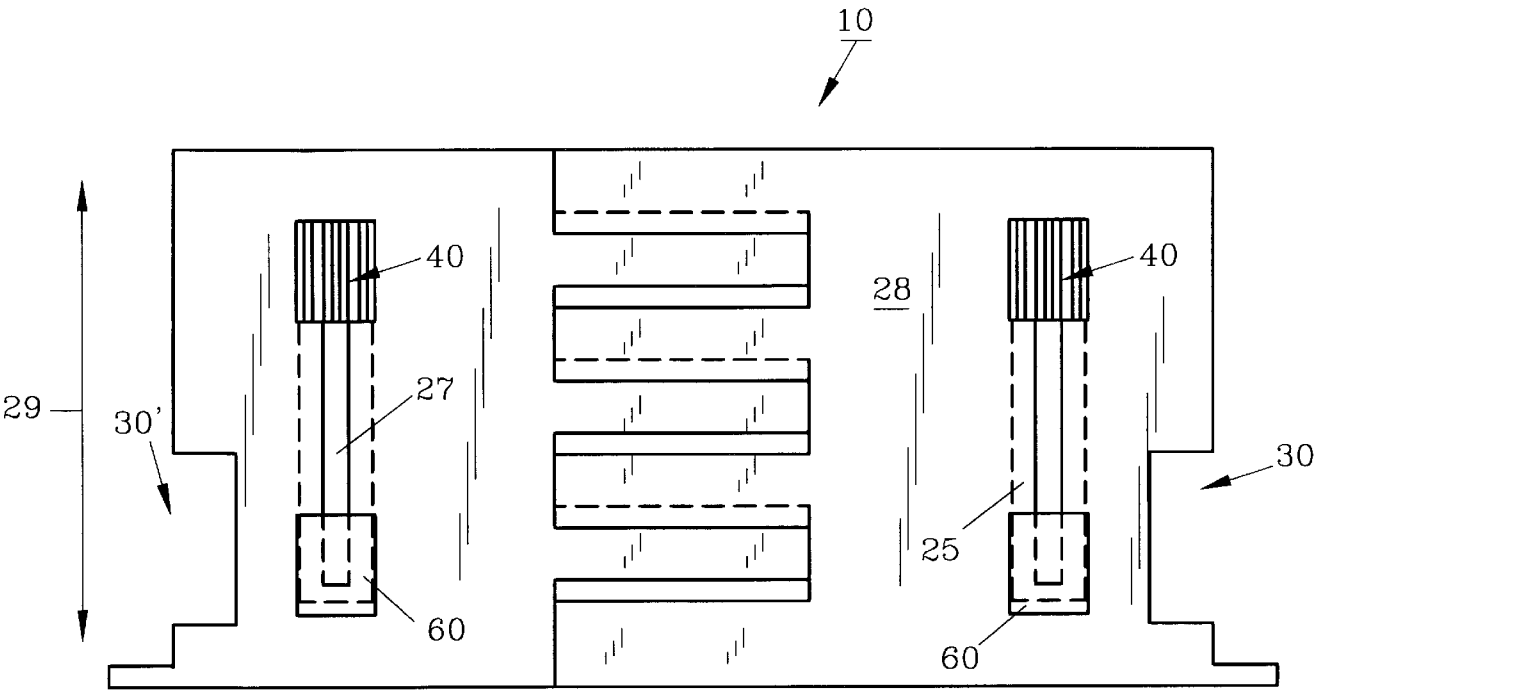
FIG. 2 illustrates a bottom view of the window support of FIG. 1.

As better seen in FIG. 2, wedge 40 and sill feet 60 may be selectively attached to bottom surface 28 of window support 10, specifically in channels 25 and 27. Wedges 40 and sill feet 60 allow window support 10 be positioned on a window sill (not shown) which includes a sloping outer surface and still be properly leveled as desired. While sill feet 60 remain generally near front flange 18, wedges 40 may move laterally within channels 25 and 27 as indicated generally by arrow 29 to level window support 10 on the biased window sill. Openings 30, 30' allow first half 11 and second half 12 to engage a window frame (not seen) for a tight, secure fit.

Figure 4:
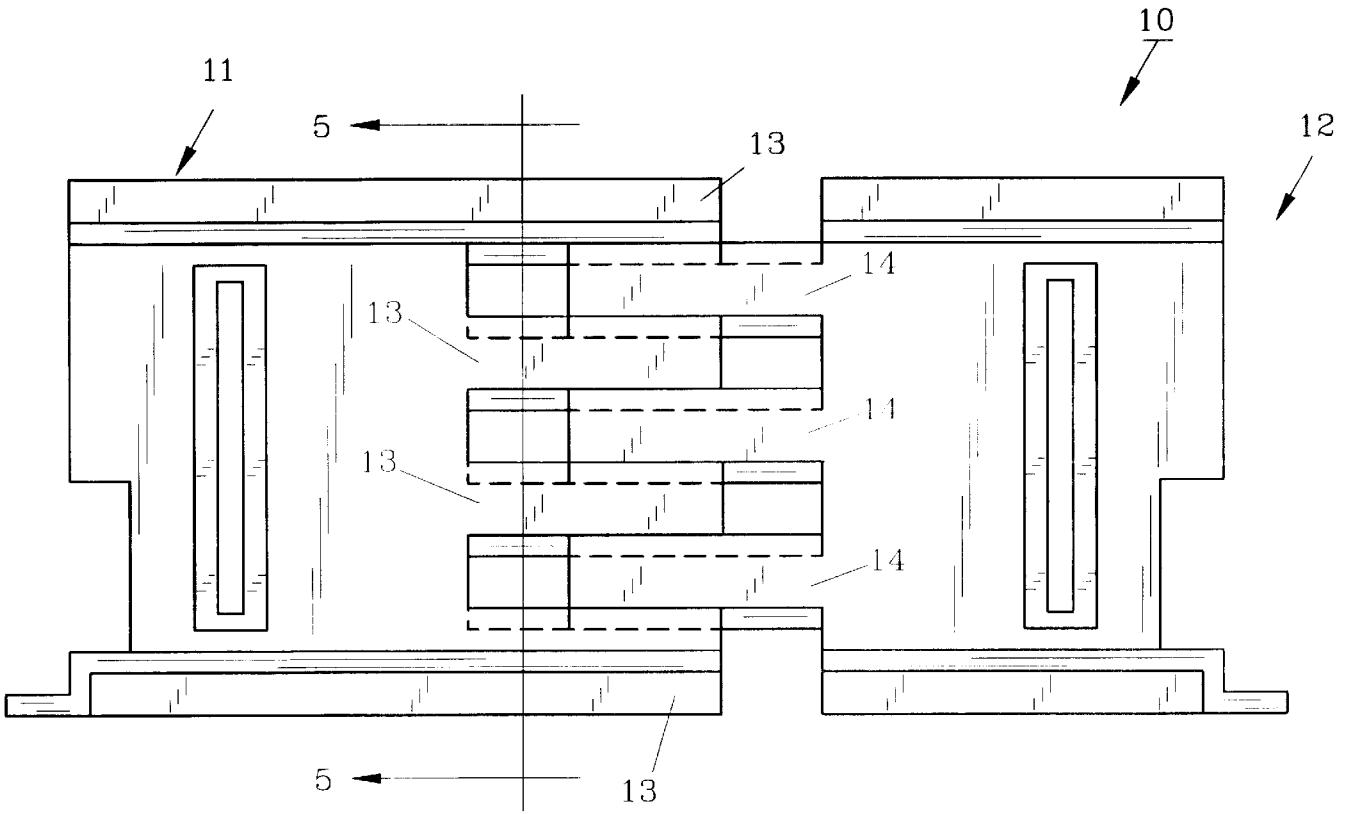
FIG. 4 features a the device of FIG. 1 in an open position.
Figure 5:
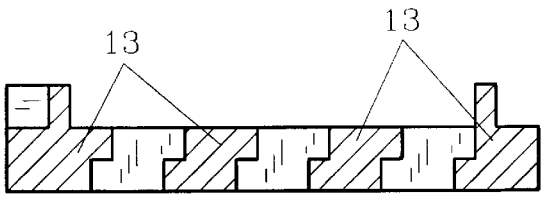
FIG. 5 depicts a cross-sectional view along lines 5—5 of FIG. 4.

Fingers 13 and 14 are generally s-shaped in cross section for suitable interweaving as seen in FIGS. 4 and 5. It should be appreciated that with the structure herein disclosed window support 10 may be "spread" to span the width of a window sill. In contrast to U.S. Pat. No. 5,112,015, which extends "front-to-back" the present invention is designed to span the width of the window.

Figure 6:
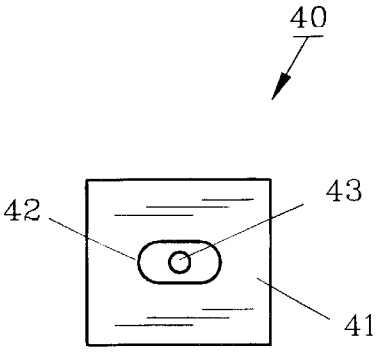
FIG. 6 pictures a top view of the wedge for use with the window support.
Figure 7:
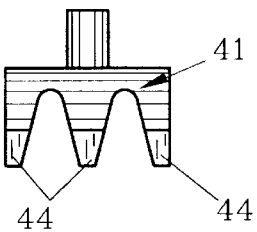
FIG. 7 shows a front view of the wedge of FIG. 6.
Figure 8:
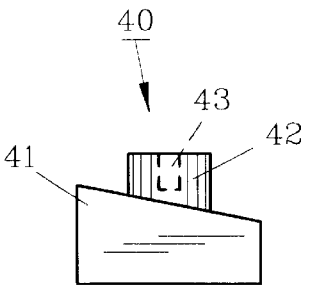
FIG. 8 illustrates a side view of the wedge of FIG. 6.

Wedge 40 is best seen in FIGS. 6–8 which disclose trapezoidal body 41 (FIG. 8) surmounted by knob 42. Generally elliptical knob 42 (FIG. 6) is sized so as to fit within channels 26 and 27 while defining channel 43 which receives a conventional threaded fastener such as a screw or bolt. Body 41 defines plurality of ridges 44 (FIG. 7) which allow wedge 40 to remain lightweight, yet provide the needed support.

Figure 10:
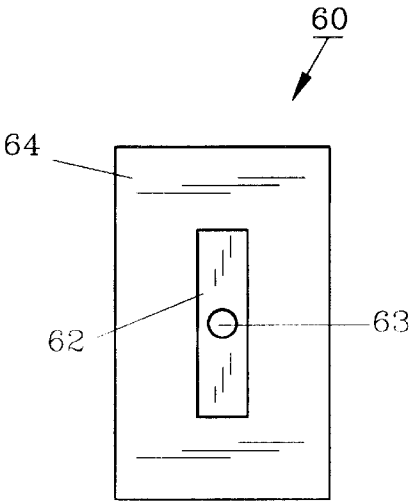
FIG. 10 represents a top view of the sill foot of FIG. 9.
Figure 9:
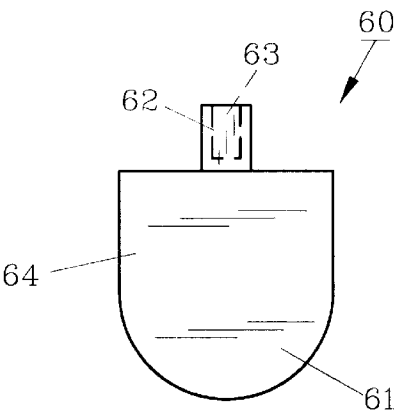
FIG. 9 demonstrates a front view of a sill foot for use with the device of FIG. 1.
Figure 11:
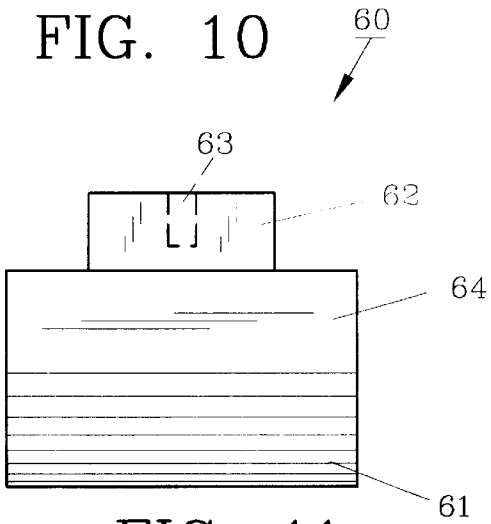
FIG. 11 features a side view of the sill foot of FIG. 9.

Additionally, sill foot 60, seen in FIGS. 9–11 may be used. Sill foot 60 comprises body 64 surmounted by knob 62. Knob 62 defines channel 63 for reception of a conventional fastener (not shown) for securing sill foot 60 at a desired location in channels 26, 27. Body 64 includes lower rounded edge 61.

The preferred method of using window support 10 comprises positioning it on a window sill (not shown) and spreading it to span the width thereof. This will open up space between first body 15 and second body 16 while leaving fingers 13 and 14 interwoven for rigidity and stability purposes. Wedges 40 and sill feet 60 are attached and positioned within channels 25 and 27 as needed to level support 10 on the window sill. An air conditioning unit or other object is then placed thereon between flanges 18 and 21. Then conventional installation procedures such as connecting the air conditioner to a power supply, closing the window to the top surface of the air conditioning unit and closing any gaps on the sides of the air conditioning unit are performed as is well understood.

The preceding recitation is provided as an example of the preferred embodiments and is not meant to limit the nature of scope of the present invention or appended claims.

What is claimed is:

1. A window support for supporting an air conditioner in a window frame, said support having a top surface and a bottom surface and comprising:

a first half comprising a plurality of fingers, an outside edge, a front edge and a back edge;

a second half comprising a plurality of fingers, an outside edge, a front edge and a back edge, the fingers of the first half inserting between the fingers of the second half so that said two halves are slidable with respect to each other; and a cutout on the outside edge near the front edge of each of the two halves, said cutouts engaging sides of the window frame when said support is mounted in the window frame and preventing movement of the support out of the window frame.

2. The window support according to claim 1, further comprising two flanges extending upwardly from the top surface and extending adjacent the front and back edges, respectively, of each of the two halves, to help position an air conditioner therebetween.

3. The window support according to claim 1, further comprising a channel disposed in each half, said channel extending parallel to said outside edge, and a leveling device slidably disposed within each channel, said leveling device keeping said support level when said support is mounted in a window.

4. The window support according to claim 3, wherein said leveling device comprises a wedge slidably disposed in said channel and extending beneath the bottom surface of the support.

5. The window support according to claim 4, further comprising a fastener for locking said wedge in a desired position in said channel once the support is level.

6. The window support according to claim 4, wherein said wedge is trapezoidal in shape and has a plurality of ridges.

7. The window support according to claim 4, further comprising a sill foot disposed in said channel, said sill foot being fastened at a desired place along said channel to further level said support.

8. The window support according to claim 1, wherein said fingers each have an approximately S-shaped cross-section.

* * * * *